US008438798B2

(12) United States Patent
McLain et al.

(10) Patent No.: US 8,438,798 B2
(45) Date of Patent: May 14, 2013

(54) ROOF PENETRATING CLOSURE STRUCTURES AND SYSTEMS

(75) Inventors: Michael J. McLain, Green Bay, WI (US); Timothy Pendley, Madera, CA (US)

(73) Assignee: T&M Inventions, LLC, Green Bay, WI (US)

( * ) Notice: Subject to any disclaimer, the term of this patent is extended or adjusted under 35 U.S.C. 154(b) by 102 days.

(21) Appl. No.: 12/932,892

(22) Filed: Mar. 8, 2011

(65) Prior Publication Data

US 2011/0252726 A1 Oct. 20, 2011

Related U.S. Application Data

(63) Continuation-in-part of application No. 12/572,176, filed on Oct. 1, 2009, now abandoned.

(60) Provisional application No. 61/102,333, filed on Oct. 2, 2008.

(51) Int. Cl.

| | |
|---|---|
| ***E04B 7/18*** | (2006.01) |
| ***E04B 7/02*** | (2006.01) |
| ***E04B 7/04*** | (2006.01) |
| ***E06B 3/26*** | (2006.01) |

(52) U.S. Cl.

USPC ..... 52/200; 52/90.2; 52/91.1; 52/202

(58) Field of Classification Search ..... 52/200, 52/18, 72, 80.1, 90.1, 90.2, 91.1, 202, 19, 52/536, 537, 545

See application file for complete search history.

(56) References Cited

U.S. PATENT DOCUMENTS

| | | | |
|---|---|---|---|
| 3,521,414 | A | 7/1970 | Malissa |
| 3,791,088 | A | 2/1974 | Sandow et al. |

(Continued)

FOREIGN PATENT DOCUMENTS

| | | |
|---|---|---|
| GB | 981948 | 2/1965 |
| JP | 2000336859 | 5/2000 |

(Continued)

OTHER PUBLICATIONS

FAA Facility, photos of skylight installation, 3 pages, Sacramento, CA.

(Continued)

*Primary Examiner* — Andrew Triggs
(74) *Attorney, Agent, or Firm* — Thomas D. Wilhelm; Wilhelm Law, S.C.

(57) ABSTRACT

The invention provides an environment-accessing structure for providing environmental access to the interior of a building through an aperture in the roof. The environment-accessing structure can provide natural day-lighting by use of a skylight lens as the closure member, or a smoke vent which can be opened and closed. Such smoke vent can be transparent or translucent to natural sunlight, or can be opaque. Such environment-accessing structure is installed in an aperture in a metal roof. The system limits opportunity for water leakage from the outside environment. The environment-accessing structure includes a rail and closure structure adapted to be supported by adjacent rib elevations of adjacent roof panels, a closure panel adapted to be supported on the rail and closure structure, and a diverter which seals a cut away portion of the rib structure and diverts water laterally away from the rail and closure structure.

45 Claims, 13 Drawing Sheets

U.S. PATENT DOCUMENTS

| | | | | | |
|---|---|---|---|---|---|
| 3,828,494 | A | | 8/1974 | Uhrhane et al. | |
| 3,967,423 | A | | 7/1976 | Hammond | |
| 4,117,638 | A | * | 10/1978 | Kidd et al. | 52/200 |
| 4,123,883 | A | * | 11/1978 | Barber et al. | 52/200 |
| 4,155,206 | A | | 5/1979 | Player | |
| 4,296,581 | A | | 10/1981 | Heckelsberg | |
| 4,470,230 | A | | 9/1984 | Weisner | |
| 4,520,604 | A | | 6/1985 | Halsey et al. | |
| 4,543,753 | A | * | 10/1985 | Sonneborn et al. | 52/15 |
| 4,559,753 | A | | 12/1985 | Brueske | |
| 4,621,466 | A | | 11/1986 | Sonneborn et al. | |
| 4,649,680 | A | | 3/1987 | Weisner et al. | |
| 4,703,596 | A | | 11/1987 | Sandow | |
| 4,730,426 | A | | 3/1988 | Weisner et al. | |
| 4,776,141 | A | | 10/1988 | Powell | |
| 4,825,608 | A | | 5/1989 | Makin | |
| 4,848,051 | A | | 7/1989 | Weisner et al. | |
| 4,860,511 | A | | 8/1989 | Weisner et al. | |
| 4,986,039 | A | | 1/1991 | Weisner | |
| 5,027,576 | A | | 7/1991 | Gustavsson | |
| 5,323,576 | A | | 6/1994 | Gumpert et al. | |
| 5,511,354 | A | | 4/1996 | Eidson | |
| 5,522,189 | A | * | 6/1996 | Mortensen et al. | 52/200 |
| 5,561,953 | A | | 10/1996 | Rotter | |
| 5,896,711 | A | | 4/1999 | McClure | |
| 6,079,167 | A | | 6/2000 | Voegele, Jr. | |
| 6,151,838 | A | | 11/2000 | Husein | |
| 6,640,508 | B2 | | 11/2003 | Lindgren et al. | |
| 6,966,157 | B1 | | 11/2005 | Sandow | |
| 7,043,882 | B2 | | 5/2006 | Gumpert et al. | |
| 7,296,388 | B2 | | 11/2007 | Valentz et al. | |
| 7,308,777 | B2 | * | 12/2007 | Sandow | 52/200 |
| 7,395,636 | B2 | | 7/2008 | Blomberg | |
| 7,712,279 | B2 | | 5/2010 | McClure | |
| 7,721,493 | B2 | | 5/2010 | Skov et al. | |
| 7,736,014 | B2 | | 6/2010 | Blomberg | |
| 2004/0049996 | A1 | | 3/2004 | Blomberg | |
| 2005/0204674 | A1 | * | 9/2005 | Marshall | 52/544 |
| 2006/0191230 | A1 | | 8/2006 | Gumpert | |
| 2007/0094984 | A1 | | 5/2007 | McClure | |
| 2007/0101665 | A1 | | 5/2007 | Sandow | |
| 2008/0040993 | A1 | | 2/2008 | Valentz et al. | |
| 2008/0190050 | A1 | | 8/2008 | McClure | |
| 2010/0162643 | A1 | | 7/2010 | Blomberg et al. | |
| 2011/0252726 | A1 | * | 10/2011 | McLain et al. | 52/200 |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Siemens Building, photos of skylight installation, 6 pages.

R & S Manufacturing and Sales Company, Inc., Standing Seam 24 Light, Quick Installation Instructions, Under/Over Seam Clip, 12 pages, Newbury Park, CA, date unknown.

R & S Manufacturing and Sales Company, Inc., SS 24 Light, The First Truely Thermally Broken Metal Building Skylight, informational sheet, 1 page, Newbury Park, CA, date unknown.

R & S Manufacturing and Sales Company, Inc., Enlarged photo of metal roof showing the down slope, 1 page, Newbury Park, CA, date unknown.

Cross-section and pictorial views of SSR-TUF-Lite daylighting panels, received Jun. 20, 2012, 1 sheet.

Cross-section of VP TUF-Lite Panel—attached to the side of SSR rib, received Jun. 20, 2012, 1 sheet.

Cross-section of Butler Lite Panel—attached to the side of MR24 rib, received Jun. 20, 2012, 1 sheet.

* cited by examiner

ROOF PENETRATING CLOSURE STRUCTURES AND SYSTEMS

REFERENCE TO RELATED APPLICATIONS

This application is a Continuation-In-Part patent application Ser. No. 12/572,176, filed Oct. 1, 2009 now abandoned, which is Non-Provisional Application of Provisional Patent Application No. 61/102,333, filed Oct. 2, 2008, the complete disclosures of which are incorporated herein, in their entireties.

COPYRIGHT NOTICE

A portion of disclosure of this patent document contains material which is subject to copyright protection. The copyright owner has no objection to the facsimile reproduction by anyone of the patent document or the patent disclosure, as it appears in the Patent and Trademark Office patent files and records, but otherwise reserves all other copyright rights.

BACKGROUND OF THE INVENTION

1. Field of the Invention

The field of the invention is skylights and skylight systems.

2. Description of Related Art

Various systems are known for installing skylights and/or smoke vents into roofs.

The most commonly used skylighting systems are those that incorporate translucent or transparent layers into a framework that penetrates the roof support structure, so as to allow ambient daylight into the building.

In the past, roof penetrating installations have required a complex structure beneath the exterior roofing panels in order to support a roof curb to which the skylight was attached. Conventional skylight curbs are generally in the form of a preassembled box structure, which is mounted within a roof cutout. The retrofitting of such curb systems into existing roof structure is problematic in that all known conventional structures have a strong tendency to leak water when it rains due to installation details and complexities that are affected by installation, technologies or workmanship.

U.S. Pat. No. 4,296,581, Heckelsberg, issued Oct. 27, 1981, teaches a roof structure having a series of metal panels having flanges that interlock when the panels are laid side by side and which are subsequently tightly seamed together to convert the individual panels into an integrated roof forming membrane. This roofing structure is mounted to the building purlins with clips and permits the panels to expand or contract in response to temperature and pressure changes.

U.S. Pat. No. 4,703,596, to Sandow, issued Nov. 3, 1987, and titled "Grid Skylight System", teaches a grid skylight support apparatus that includes prefabricated grid row frames, each formed of connected beam supports which define a number of bays. Each bay has a skylight curb formed by upper flanges of the beam supports to receive a preassembled skylight unit. The sides of each grid row frame provide mating edges that can register with the mating edges of adjacent other grid row frames during assembly. The skylights have peripheral support skirts that register upon each bay and a light-transmitting skylight panel to cover the peripheral support. Cross gutters on each grid row frame, which are positioned between adjacent skylights, extend at angles toward the respective mating edges of the grid row frame for carrying rainwater to a main gutter channel formed by field-assembly of the mating edges of two adjacent grid row frames. The main gutter channel includes a pair of longitudinally extending gutter sections, each having a main gutter channel surface with a lower elevation than the elevation of the cross flow channel. Fasteners assemble the grid row frame mating edges together and a continuous seal is provided to prevent rainwater leakage at the mating edges of adjacent grid row frames.

U.S. Pat. No. 4,520,604, to Halsey et al., issued Jun. 4, 1985, entitled "Skylight Structure", teaches a curb structure dimensioned to be passed through an opening in a roof and then attached in asserted moisture impervious relation to the roof from within a building interior. A skylight assembly including a frame, and light transmitting member secured to the frame is dimensioned to be passed through the opening and attached in a sealing engagement to the curb structure from within the building interior for covering the opening. The skylight assembly is then secured to the rafters and headers at an interior location. The frame includes upper and lower clamping jaws and spaced fulcrum links attached to the jaws for clamping the light transmitting member thereto. The lower clamping jaws include a channel which engages and is interlocked with the curb structure.

Other skylight systems, as contemplated in U.S. Pat. No. 4,470,230, by Weisner, provide a prefabricated skylight support curb that is formed to be a protective packaging for the skylight during shipment and then used as a curb for mounting the skylight on a roof. A prefabricated skylight support curb for supporting a skylight thereover has a bottom flange angled, upright sides, and a top lip round the top of the sides forming an opening through the curb. A skylight is adapted to cover the opening through the skylight support curb, and has a domed portion and a drip edge on the curb portion. The skylight curb portion is shaped to fit over a portion of the prefabricated skylight support curb angled upright portion and top lip. The skylight support curb is shaped to nest an accompanying skylight therein having the skylight curb portion adjacent to the interior of the skylight support curb angled upright walls to protect the skylight during shipping and storing.

Another skylight system, U.S. Pat. No. 3,791,088, Sandow, et al., teaches prefabricated multiple dome unit or skylights and composite provided, where each multiple dome unit has several domes of transparent or translucent material mounted together on a common frame, and means are provided for assembling a plurality of such dome units into a composite thereof on a building, with the units lapped and interfitted so as to provide a continuous drainage system discharging to the exterior of the units in the composite assembly.

U.S. Pat. No. 4,621,466, by Sonneborn et al., teaches a flashing frame described for roof windows to be installed adjacent to each other with edges facing each other. Connecting flanges of the upper flashing members extend beneath the roofing and, if need be, lower flashing members and intermediary flashing members extend obliquely outwardly.

In today's world of mandated energy efficiency in all types of buildings, the metal building industry needs a more effective way to use skylights and smoke vents to bring daylight into buildings, as well as a more effective way to mount a variety of roof penetrating items. To ensure adequate daylighting, however, typical skylight and smoke vent installations require multiple roof penetrations that cut through and remove plural major elevations in standing seam and other roof panel profiles. These curbs create multiple opportunities for water to enter the interior of the building, due to multiple curb locations and the widths of the curbs, as well as presenting the challenge to effectively seal the roof at the high ends of such curbs.

The traditional curb constructions and methods of attachment in most cases require a complicated support structure to be installed below the roof panel which can restrict movement associated with thermal expansion and contraction of the overlying metal roof due to temperature changes and the like.

None of the prior approaches have been able to provide an installation system for multiple skylights which accomplishes the goals of economy and simplicity of installation and which works equally well for new buildings and as retrofits in existing buildings.

SUMMARY OF THE INVENTION

The invention provides a curbless construction system for installing two or more adjacent environment-accessing closure structures, such as skylights and/or smoke vents, end-to-end, onto the major rib elevation of a building's metal roof panel system thus utilizing the beam strength of the rib elevations in supporting roof-penetrating structures. Numerous roof structures include such rib elevations, sometimes deemed "ribs" or "corrugations", including the standing seam, snap seam and "R" panel roof types. The rail and closure system of the invention is fastened to the rib structures of the metal roof panels above the water line, so that the skylight/vent system can move with the expansion and contraction of the roof.

The invention utilizes the beam strength rib elements of the roof panels as an integral part of the closure support structure.

In a first family of embodiments, the invention comprehends a roof adaptive system configured to be installed as a roof-penetrating, environment-accessing structure on a metal roof, such metal roof comprising a metal roof profile defined by a plurality of roof panels having lengths, and arranged side by side, edges of adjacent such roof panels meeting at elevated rib structure portions thereof. The roof adaptive system comprises a rail and closure structure configured to be supported by adjacent ones of the elevated rib structures of the respective roof panels; a closure member configured to be supported on said rail and closure structure; and a diverter member configured to seal a cut away portion of such rib structure, thus to divert water away from the rail and closure structure.

In some embodiments, the rail and closure structure comprises an elongate rail configured to conform to at least a portion of a cross-section of such rib structure, along the length of such elevated rib structure.

In some embodiments, the rail and closure structure comprises first and second elongate rails configured to conform to respective first and second rib structure on respective adjacent roof panels.

In some embodiments, the roof adaptive system further comprises an upper end diverter configured to conform to an upper surface profile of such roof panel as is to be spanned by the rail and closure structure, and to close off the rail and closure system at the upper end thereof from intrusion of water.

In some embodiments, the roof adaptive system further comprises a lower end roof panel profile closure configuration to close off the lower end of the rail and closure structure from intrusion of water.

In some embodiments, the lower end roof panel profile closure conforms to the elevated rib structure of a known such roof panel.

In some embodiments, the lens comprises a skylight lens mounted to a skylight frame which extends about a perimeter of the lens, the skylight frame being fastened to the rail structure at spaced locations along the length of the rail structure.

In some embodiments, the aperture closure comprises a skylight lens.

In some embodiments, the aperture closure comprises an operable vent which can be alternatively closed, and opened to the outside environment.

In a second family of embodiments, the invention comprehends a building, comprising a building structural support system; and a roof supported by the structural support system. The roof comprises a plurality of elongate roof panels arranged in side-by-side relationship, the roof panels having first lengths, defining opposing first and second ends thereof, and opposing first and second sides of the roof panels, the sides of the roof panels comprising elongate elevated rib structure, the elevated rib structure on a first such roof panel being joined with the elevated rib structure on adjacent roof panels to form first and second elevated ribs at such joinder, the roof panels further comprising panel flat portions between the elevated ribs, an aperture in the roof, the aperture being confined within the width of a single such roof panel, and a roof-penetrating, environment-accessing structure. The environment accessing structure comprises a rail and closure structure having a second length defining third and fourth ends thereof, and a second width, corresponding directionally to the first lengths and the first widths of the roof panels, first and second elongate rails extend along the length of the rail and closure structure, the first and second rails being attached to the elevated ribs at spaced locations along the lengths of the ribs and the rails, the rail and closure structure spanning the width of a single roof panel plus optionally a rib portion of an adjacent roof panel. A diversion slot has a width corresponding in direction to the length direction of the respective panels. The diversion slot extends across an elevated rib at, and extending away from the upper end of the rail and closure structure, and at an elevation corresponding with an elevation of the respective said panel flat. At least one closure panel is secured to, and supported by, the rails, and a diverter is disposed in the diversion slot, extending the width of the diversion slot and extending across the respective rib, thereby to divert water laterally away from the end of the environment-accessing structure and onto the adjacent roof panel.

In some embodiments, the elongate rails have cross-section profiles which parallel cross-section profiles of the respective elevated ribs such that the rails are in substantial face-to-face contact with the respective ribs along the lengths of the ribs and the rails.

In some embodiments, the environment-accessing structure comprises at least first and second environment-accessing structures in side-by-side relationship to each other and overlying a single aperture.

In some embodiments, the rail and closure structure is secured to and moves with elevated ribs.

In some embodiments, the first and second rails conform to profiles of the first and second ribs along the lengths of the respective roof panels.

In some embodiments, the rails are configured to conform to surfaces of respective ribs, whereby the environment-accessing structure moves with expansion and contraction of the respective ribs.

In some embodiments, the roof comprises a sloped roof, and comprising an upper end diverter configured to conform to a top surface profile of the respective roof panel overlain by the environment-accessing structure at an upper end of the environment-accessing structure, and closing off the rail and closure structure at such upper end thereof from intrusion of water into the roof aperture.

In some embodiments, the environment-accessing structure further comprises a lower end roof panel profile closure, closing off the lower end of the rail and closure structure from intrusion of water.

In some embodiments, the lower end closure conforms to the outer surfaces of the respective elevated ribs.

In some embodiments, the aperture closure comprises a skylight lens mounted to a skylight frame, the skylight frame extending about a perimeter of the lens, the skylight frame being mounted to the rail structure, at spaced locations along the length of the rail structure.

In some embodiments, the aperture closure panel comprises a skylight lens.

In some embodiments, the aperture closure comprises a smoke vent lens.

These and other features and advantages of this invention are described in, or are apparent from, the following detailed description of various exemplary embodiments of apparatus and methods according to this invention.

BRIEF DESCRIPTION OF THE DRAWINGS

A more complete understanding of the present invention and the attendant features and advantages thereof may be had by reference to the following detailed description when considered in conjunction with the accompanying drawings wherein various figures depict the components and composition of the multiple skylight system.

Figure 1:
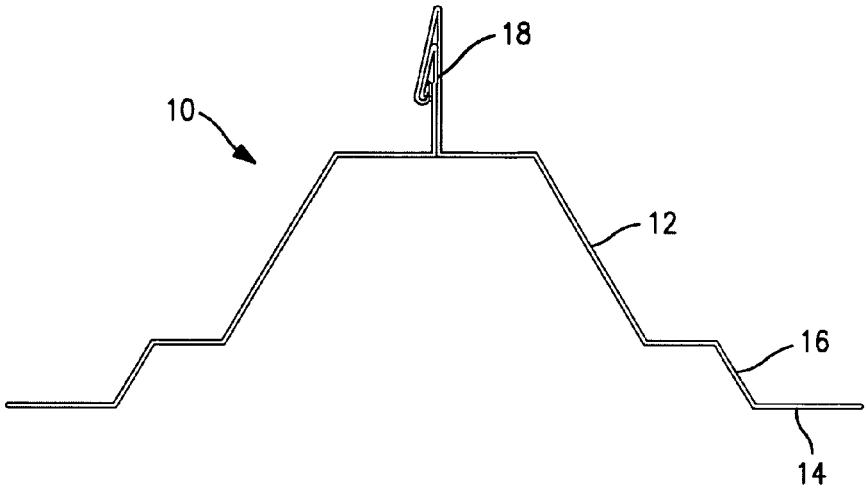
FIG. 1 is a view showing the roof profile of a metal roof of the type known as the standing seam roof panel.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The products and methods of the present invention provide a rail and closure system for use in installing various roof penetrating structures in metal roofs. For purposes of simplicity, "roof penetrating structures" and "skylights" will be used interchangeably to mean various forms of roof structures installed for passage of light and/or ventilation air handling, vents, air intake and exhaust to and/or from the interior of the building. In the case of roof ventilation, examples include simple ventilation openings, such as for roof fans, and smoke vents, which are used to allow the escape of smoke through the roof during fires.

The number of skylights can vary from one to many structures connecting end to end, as many as the building roof structure can support, limited only by the amount of support provided by the surrounding roof surface structure, which is left largely intact during the installation process.

The system utilizes the beam strength of the major rib structure in the roof as the primary support structure, for mounting and fastening the skylight assembly. Typical conventional skylight installations do not allow for skylights to be mounted to each other, end to end, in continuous runs without intervening roof structure along the lengths of such runs. Rather, typical conventional skylight installations use a curb construction surrounding and supporting each skylight lens, the curb structure being typically 2-4 times wider than skylight support structure used in the present invention.

The skylight system of the invention does not require a complex structure underneath the panels or a separate curb construction to support or attach the skylight. Rather, the rail and closure assembly of the invention is overlaid onto the roof system and thereby allows for thermal expansion and contraction of the skylight system members by utilizing major profiles of the e.g. conventional metal roof panel for support. This is accomplished through direct attachment of the rail assembly of a skylight of the invention, and a combination of the panel flat and the major ribs for support and attachment of the skylight lens as part of the closure assembly.

In reference now to the figures, the system allows the installation of two or more adjacent skylights in an end to end fashion along the major rib structure of a building's metal roof panel profile.

The skylight systems may be applied to various types of ribbed roof profiles. FIG. 1 is an end view showing the roof profile of a metal roof of the type known as a standing seam roof. These include the "standing seam" roof, which has trapezoidal major ribs 12 typically 24" to 30" on center. Each panel 10 also includes the panel flat 14, having a shoulder 16 and is seamed at adjacent panels forming a standing seam 18, which is folded over and seamed to prevent water from penetrating the roof at the standing seam.

Figure 2:
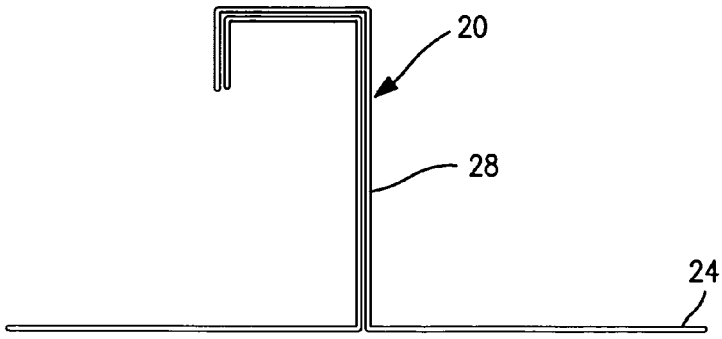
FIG. 2 is a view showing the roof profile of a metal roof of the type known as an architectural standing seam roof.

FIG. 2 is an end view showing the roof profile of a metal roof of the type known as an architectural standing seam roof, which uses a series of overlapping architectural standing seam panels 20. Each panel 20 comprises a panel flat 24, with an architectural standing seam 28 formed at the panel interconnections.

Figure 3:
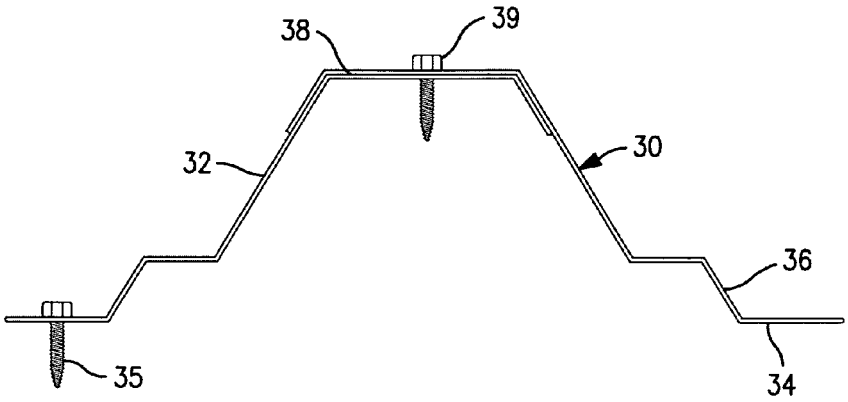
FIG. 3 is a view showing the roof profile of a metal roof of the type commonly referred to as a snap seam roof.

FIG. 3 is a view showing the roof profile of a metal roof of the type commonly referred to as an R panel or exposed fastener panel 30. Each panel has a rib 32, and a panel flat 34. Adjacent R panels are secured to the roof through structural fasteners 35. At shoulder 36, which is formed from overlapping regions, or at side lap 38, the adjacent panels are secured through a stitch fastener 39. The trapezoidal major ribs of the R panel roof are most typically formed at 8 inches to 12 inches on center.

Figure 4:
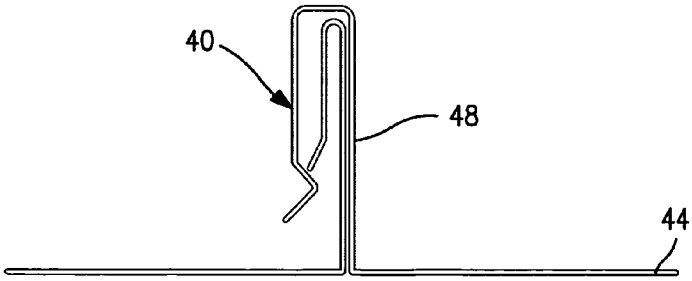
FIG. 4 is a view showing the roof profile of a metal roof of the type commonly referred to as an exposed fastener roof panel.

FIG. 4 is a view showing the roof profile of a metal roof of the type commonly referred to as a snap rib seam panel 40. Snap seam panels 40 have a panel flat 44 and a standing seam or snap seam 48 where the adjacent panels meet.

Figure 5:
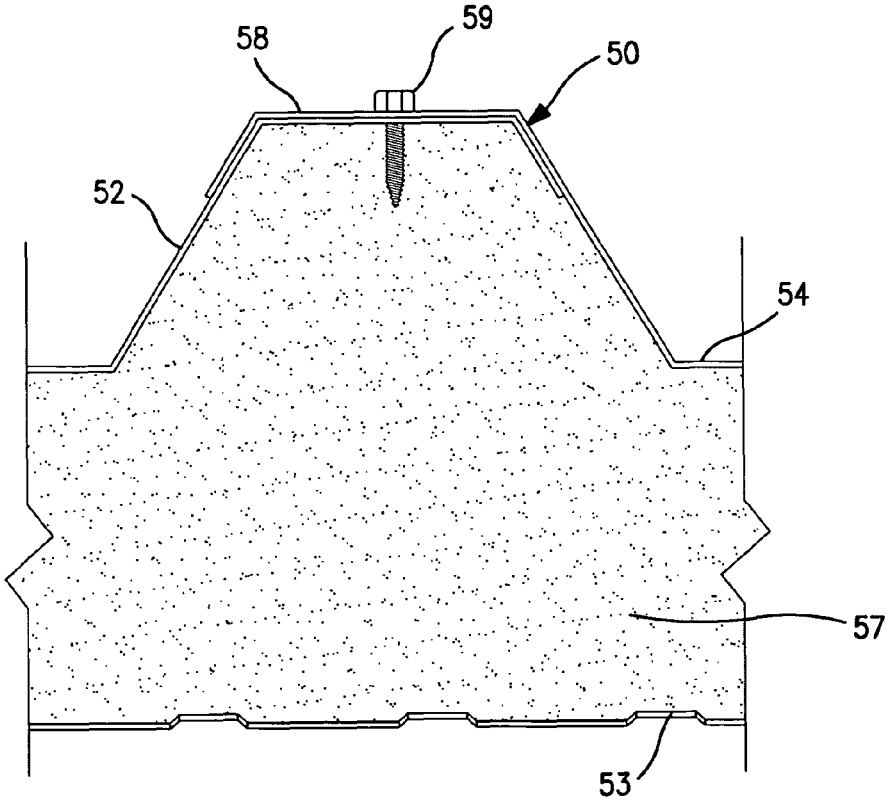
FIG. 5 is a view showing the roof profile of a metal roof of the type commonly known as foam core panel.

FIG. 5 is a view showing a roof profile of a metal roof of the type commonly referred to as using a foam core panel 50. Such roof has a rib 52, a liner panel 53, a panel flat 54 and a foam core 57. Side laps 58 are secured by stitch fasteners 59. Such roof panels are typically installed from the interior of the building.

A skylight/ventilation access system of the invention includes a rail and closure assembly adapted to be supported by the prominent elevations, seams, rib structures, or other structural elements of conventional such roof profiles, where the standing structure of the roof system e.g. at seams which mount adjoining exterior roof panels to each other, provides the support for the skylight/ventilation assemblies, and the skylight/ventilation assemblies are secured to the conventionally-existing elements of the roof structure, through an opening formed largely in the intervening, non-structural roof flat region and without removing significant portions of the rib/seam/elevation structures.

Figure 6:
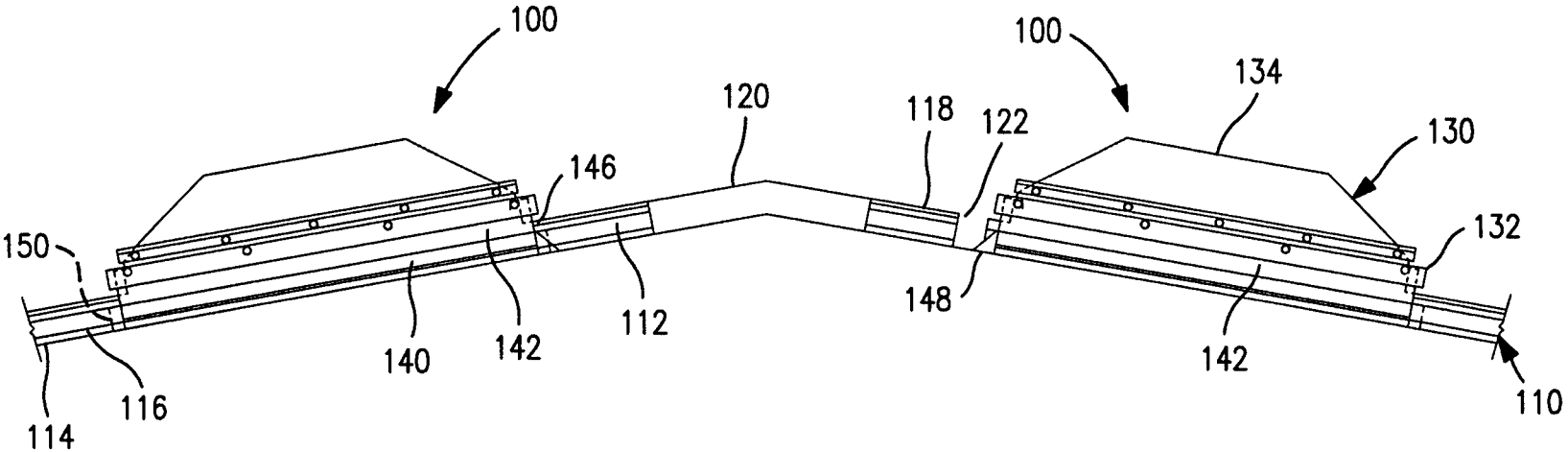
FIG. 6 is a side view showing major components of the system as installed in a metal roof.

Turning now to FIG. 6, there is shown two exemplified rail and closure assemblies 100 attached to a standing seam panel roof 110. While FIG. 6 depicts such assembly, the components can be adapted, by shaping of the elements, for attachment to any roof system which has a profile which includes elevations which provide places for structural support of the respective skylight assemblies.

Figure 7:
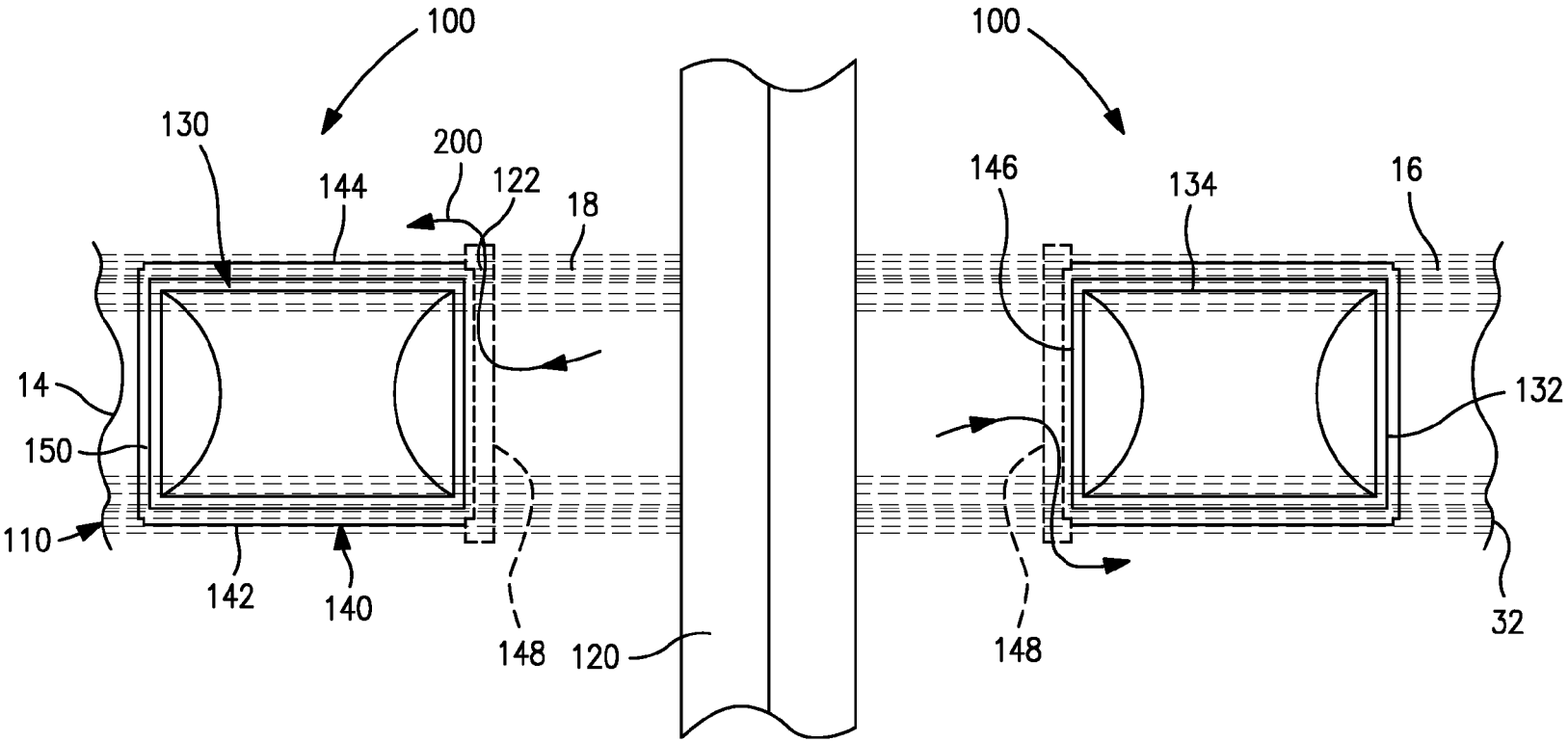
FIG. 7 is a top plan view of the installed system, showing the placement of skylights and the direction of water flow over the roof.

Looking again to the figures, particularly FIGS. 6 and 7, there is shown a portion of such a standing seam panel roof 110, in dashed outline, having structural and other elements including a raised rib 112, a panel flat 114, shoulder 116 and standing seam 118. Also depicted are the ridge cap 120 of the roof structure, and cutaway region, or gap 122 in the raised rib 112 on one side of each rail and closure assembly, the gaps being formed to accommodate the structure, as described more fully as follows.

Shown as part of the system, and exemplified in this case, is a skylight assembly 130, generally comprising a skylight frame 132 and skylight lens 134. While the figures depict a skylight, it will be understood that the system also can be adapted for use with a variety of roof penetrating closure structures, including various types of skylights, smoke vents, other ventilating structures, and/or other roof penetrating structures, all of which can be adapted to be supported on the rail and closure assembly system of the invention.

Again referring to FIGS. 6, 7 and 9, the system includes a rail and closure structure 140, generally comprised of side rails 142 and 144, and upper diverter 146 disposed at the rib cutaway section, or gap 122. A plate 148 may be located under gap 122, and thus under diverter 146, to prevent the water from leaking through the roof. With lower flange 410 of the diverter overlying the gap, and plate 148 underlying the gap, plate 148 and lower flange 410 can be fastened securely to the roof panel, and to each other, using apertures 430.

FIG. 7 shows how gap 122 in roof rib 112 allows water flow 200 to move laterally along the roof surface, over plate 148, and down and away from the roof ridge cap 120 in panel flats 114 of roof panels which are adjacent the roof structures which support the respective e.g. skylights.

Rail and closure assembly structure 140 also includes a lower closure 150 to close the roof penetration from the elements at the lower end of the e.g. skylight.

Figure 8:
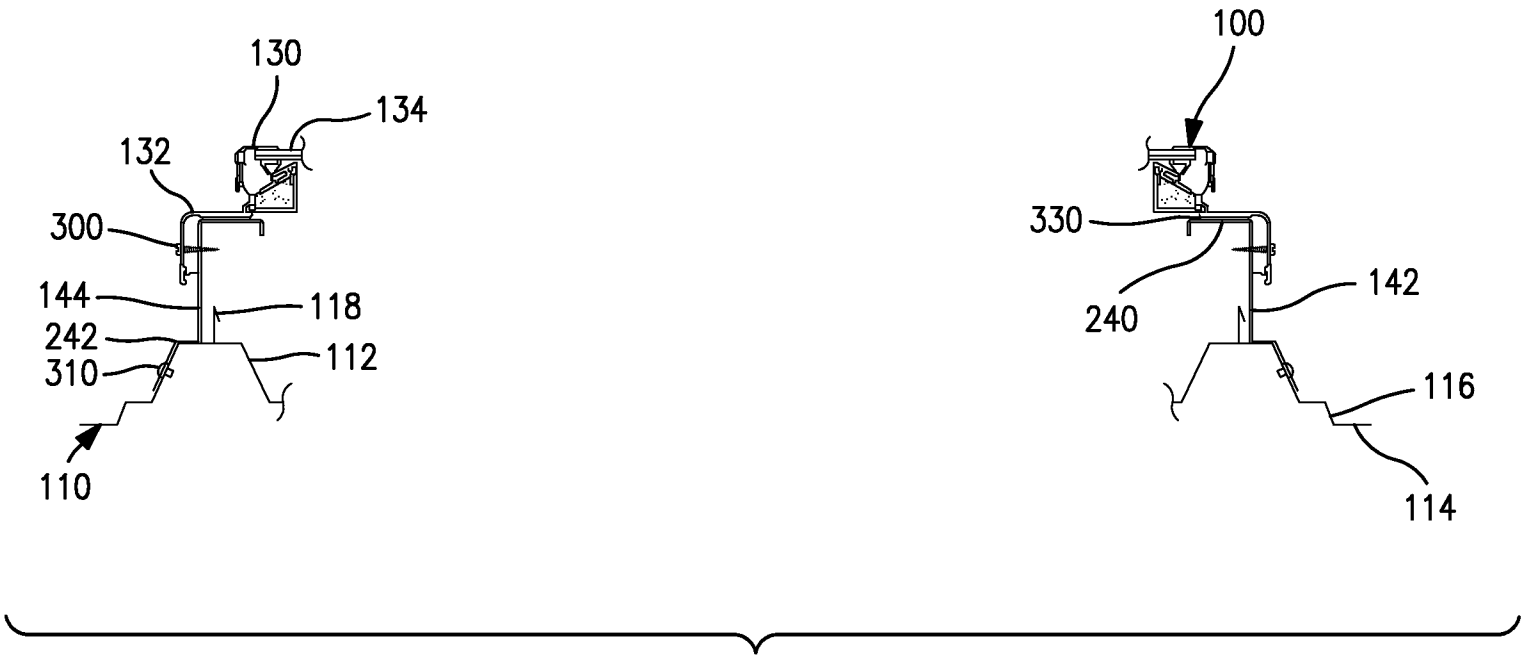
FIG. 8 is a cross sectional view showing the connections of the skylight frame to the rail and closures structure, and the latter affixed over the surface of adjacent rib elevations of the metal roof.

Referring now to FIG. 8, a cross section through the rail and closure structure 100 shows the securement of structure 100 to standing rib portions of the standing seam panel roof 110. FIG. 8 depicts the use of first and second ribs 112 to support the side rails 142 and 144 on opposing sides of the rail and closure structure 100. Each side rail 142 or 144 has an upstanding web 238 extending upwardly above the respective rib and supporting a rail upper flange or bearing panel 240, and a rail shoulder 242 extending downwardly from web 238. The rail 142 or 144 and skylight frame 132 are fastened to each other by fasteners 300, only one of which is shown, spaced along the length of the rib.

Figure 9:
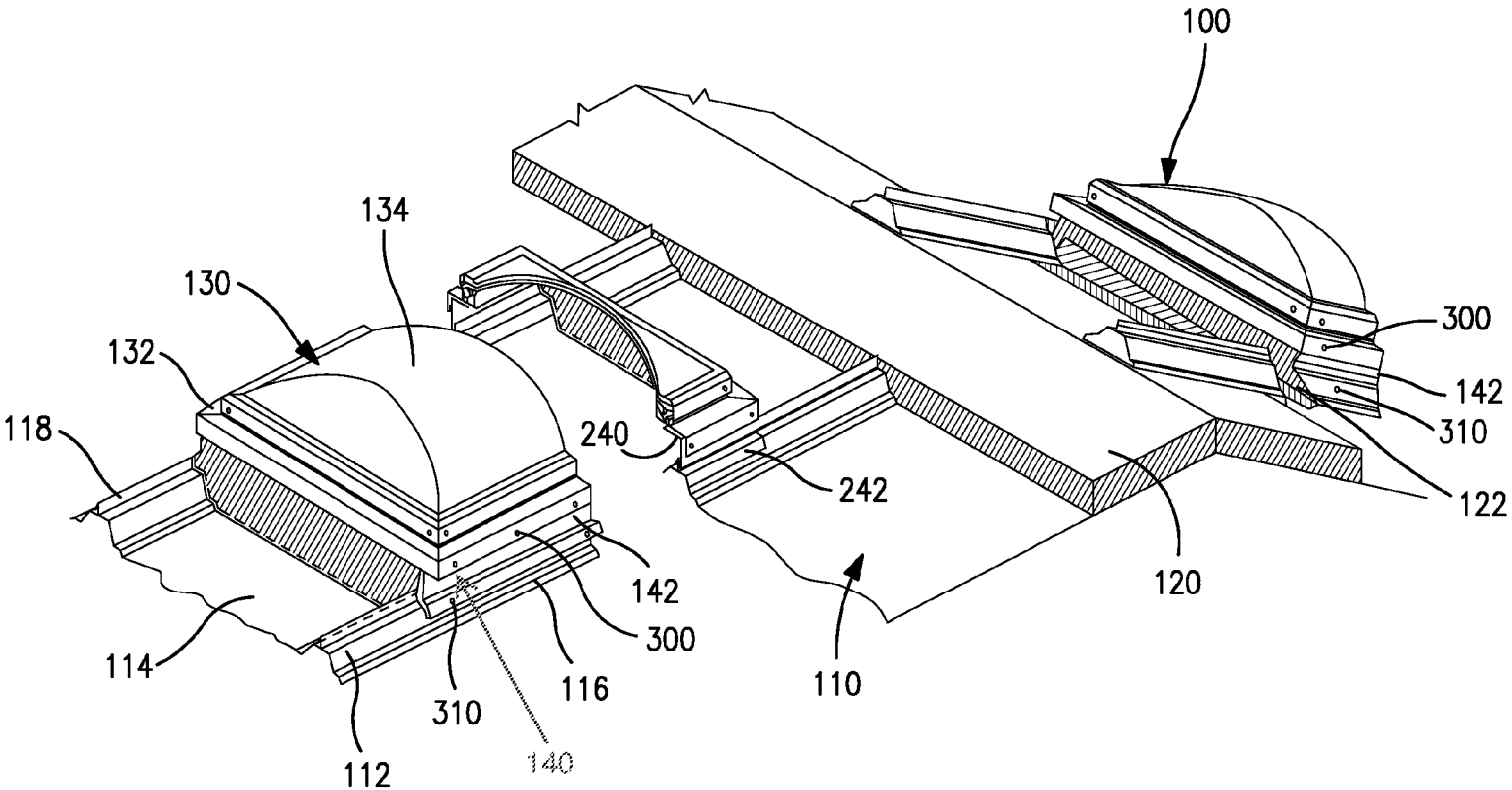
FIG. 9 is a perspective view partially cut away showing internal structure of the system as installed on the rib elevations of a metal roof.
Figure 10:
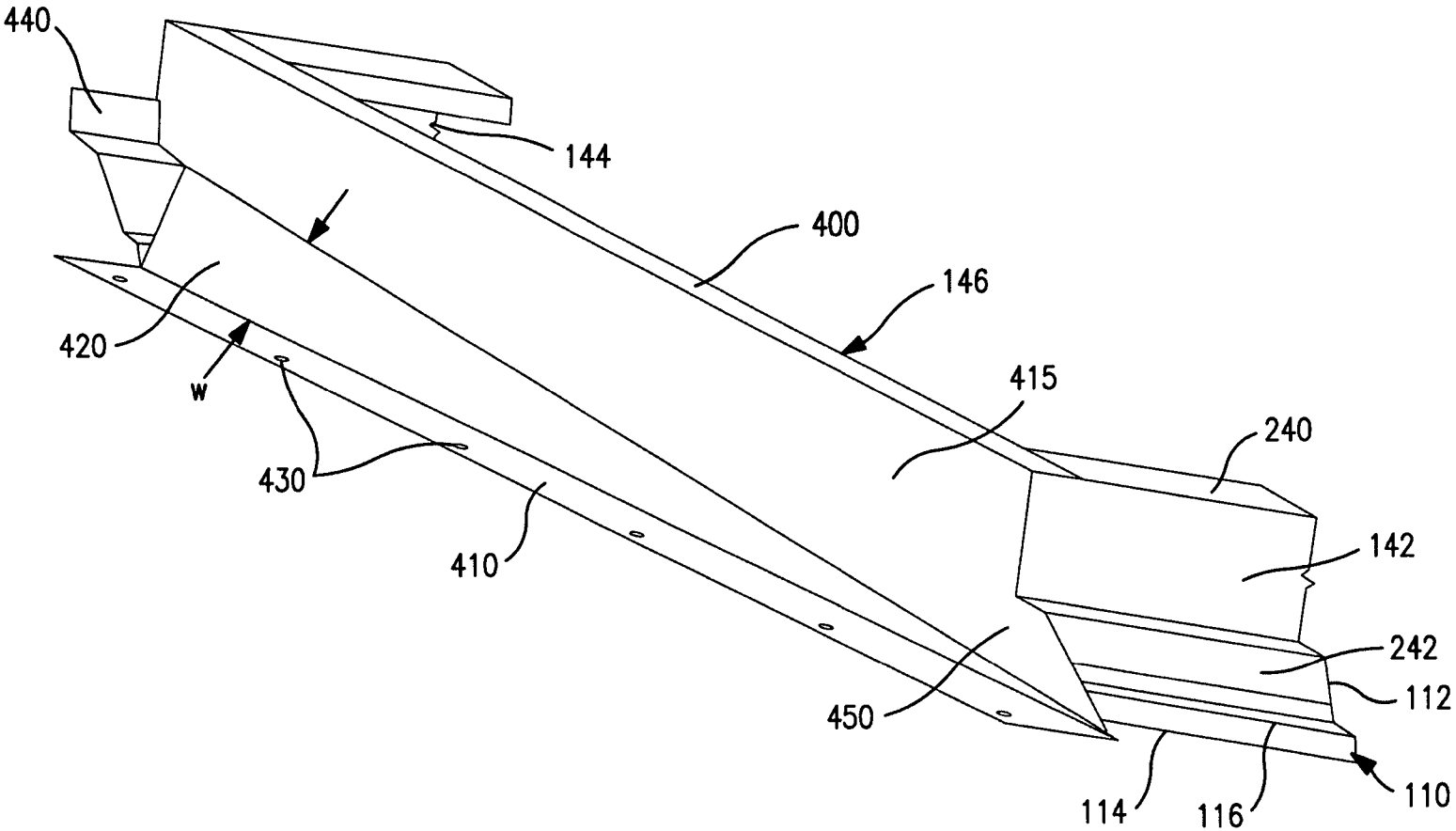
FIG. 10 is a perspective view of the upper rain pan or diverter of the rail and closure structure.

Rail shoulder 242 is shaped to fit closely over the outside of the roof rib 112, and is secured to roof rib 112 by rivets 310, only one of which is shown, spaced along the length of the rib. As illustrated in FIGS. 8-9, the entire length of the rail overlies the corresponding rib 112 and the lower edge of the rail is typically above, and displaced from, panel flat 114, and is above shoulder 116 of the respective rib. Rail bearing surface 240, at the top of the rail, supports the skylight frame 132. A sealant 330 is disposed between bearing surface 240 and skylight frame 132, to seal against the passage of water or air across the respective joint.

Rail and closure structure 140 of assembly 100 can be produced to fit closely along the contour of the roof 110, and can be so configured to have end portions that match the contour of the respective ones of ribs 112. The various mating surfaces of the structure 140 and the roof 110 can be sealed in various ways known to the roofing art, including caulking or tape mastic, or various rubber fittings or inserts can be provided to be used to seal around the open area of the penetration of the panel roof.

In FIG. 9 a partially cut away perspective view of rail and closure structures 100 is used to show support of the rail and closure system by standing seam panel roof 110, particularly the elevated rib 112 providing the structural support at the standing seams. FIG. 9 illustrates how the rail and closure system incorporates the structural profiles of the roof panels of the metal roof structure above and below the skylights, and incorporates the elevations and ribs used in sealing adjacent panels, to provide the primary support for the skylights. In this fashion, the system adopts various ones of the advantages of a standing seam roof.

Most standing seam roofs are seamed using various clip assemblies that allow the roof panels to float relative to each other, along the major elevations, namely along the joints which are defined at elevated ribs 112. Typically, the roof is fixed at the eave and allowed to expand and contract relative to a ridge. Very wide roofs can be fixed at midspan and expand and contract relative to both the eave and ridge. The design of the skylight system of the invention takes full advantage of the floating features of contemporary roofing structures, such that when rail and closure structures of the invention are so secured only to the respective rib elevations and panel flats of the roof panel structures, the rail and closure structures, themselves, are able to draw strength from the structural load bearing capacities of the roof profile, and to float along with the roof panels to which they are mounted.

FIG. 9 shows panel flat 114, rib 112, and shoulder 116, as well as standing seam 118. The ridge cap 120 is also shown, as well as the gap in the roof at 122.

Skylight 130 is supported on rail and closure structure 140, as previously described.

Rail and closure structure 140 is secured, by its side rails 142 and 144, by a series of fasteners 300, to overlying skylight frame 132 and is secured to ribs 112 by a series of rivets 310. FIGS. 8 and 9 illustrate that the skylight lens 134, as so secured to rail and closure structure 140, is above ribs 112.

In application, for each structure 140 a single rib 112 is typically cut away to accommodate drainage at the high end of the closure structure (toward ridge cap 120). This is an important feature for standing seam, architectural standing seam and snap seam roofs. Two ribs may be cut for roofs having an "R" panel profile.

The retained portions of rib 112 serve as a beam, supporting side rails 142 and 144 and maintaining the conventional watertight seal at the joints between roofing panels, along the length of the assembly. Internal portions of ribs 112 may be removed to allow additional light from skylight lens assembly 130 to reach through the respective roof opening.

A single bearing plate structure 148 is used for sealing to the roof panel and to the rail and closure structure 140 at the respective cut away rib. Bearing plate 148 also provides support to link adjacent rib elevations 112 to each other, and is typically produced of steel or other material sufficient to provide a rigid substructure to the skylight rail and closure structure.

Rail and closure structure 140 is shaped in such a manner that rail and closure structure 140 can be easily fastened directly to the respective underlying rib, with rivets or fasteners such as screws and the like as illustrated at 310 in FIGS. 8-9. The rail and closure structure 140 may also be designed to ac p safety security guard before the skylight is installed.

Figure 11:
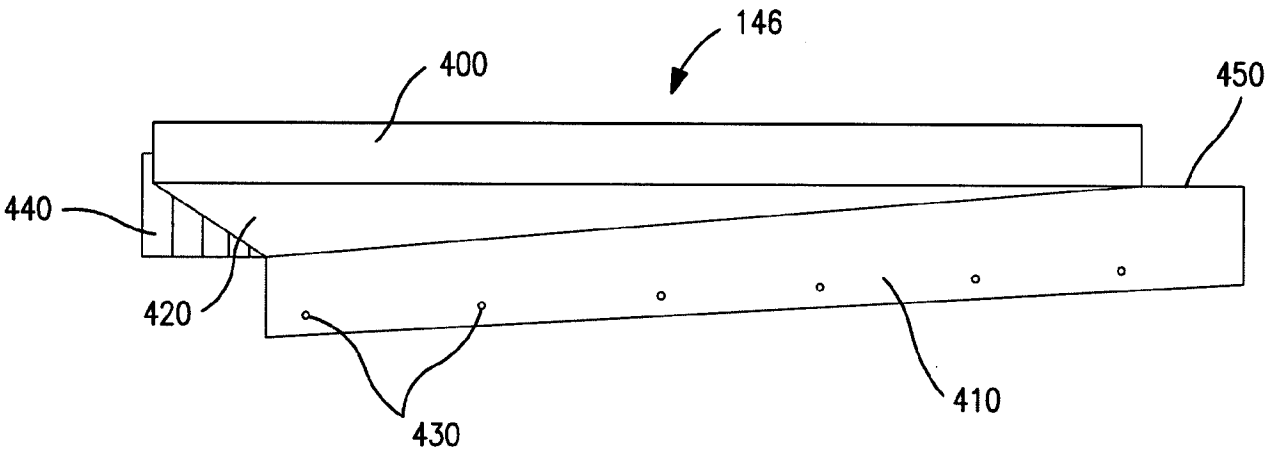
FIG. 11 is a top view of the upper rain pan or diverter of the rail and closure structure.
Figure 12:
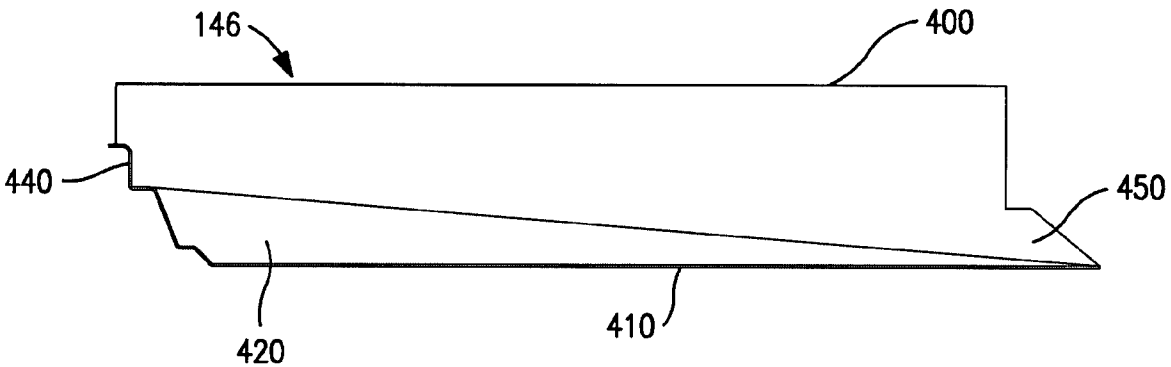
FIG. 12 is a front view of the upper rain pan or diverter of the rail and closure structure.
Figure 13:
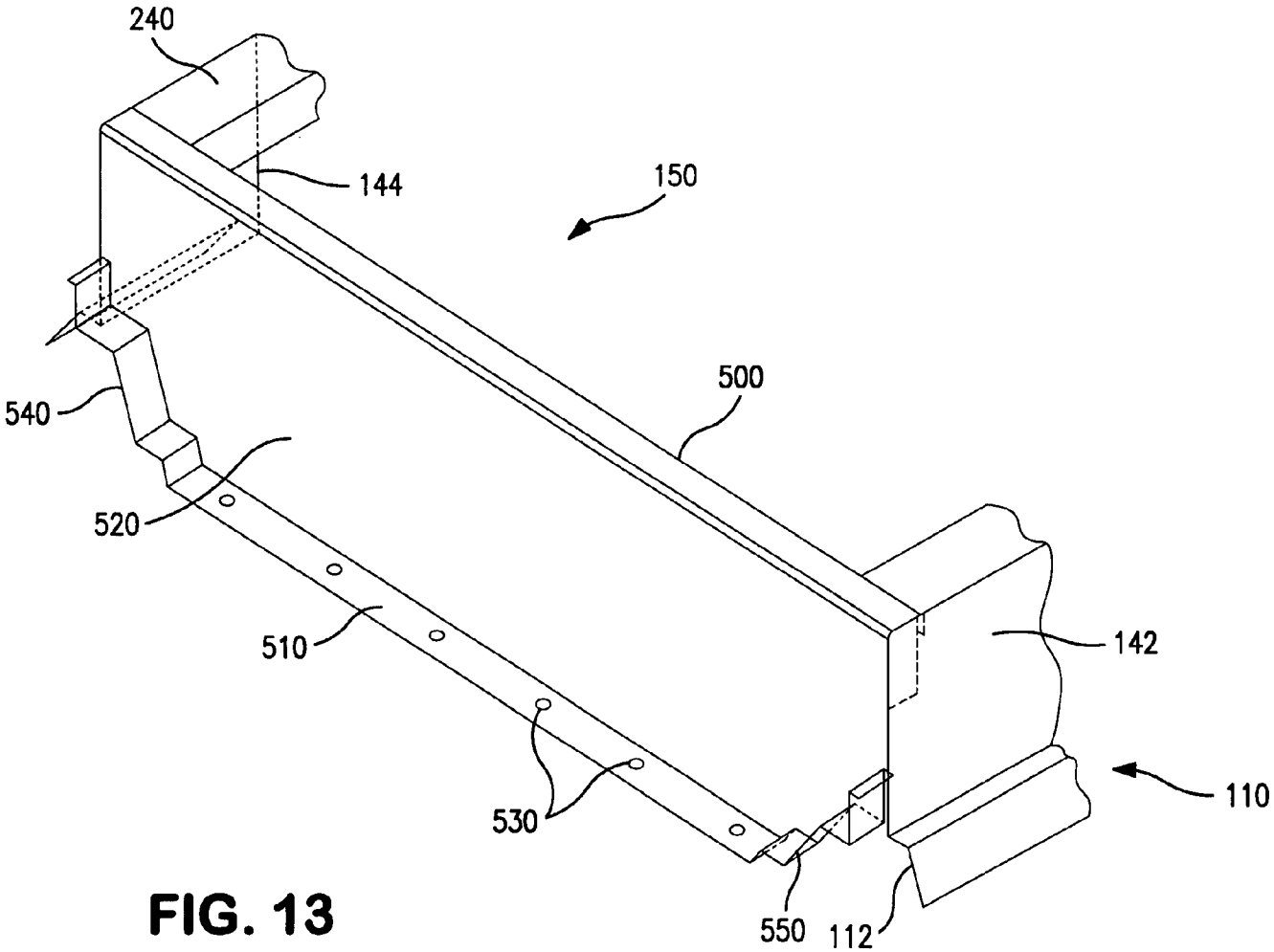
FIG. 13 is a perspective view of the lower end roof panel profile closure or lower closure of the rail and closure structure.

Looking now to FIGS. 11 through 13, upper or high end diverter 146 provides closure of the roof penetration at the upper end of the roof penetration, and diversion of water around the upper end of the assembly, to an adjacent panel flat. Diverter 146 also provides a weather tight seal at the upper end of the assembly, with the plate 148 (not shown in FIGS. 11-13) in combination with conventional sealant materials. In reference to side rails 142 and 144 of a standing seam panel roof 110, the diverter 146 generally fits the profile of the rib 112 at the region of the cut away gap 122. The side rails 142 and 144 abut the diverter 146 and the height of diverter 146 closely matches the side rails in height. Upper flange 400 of diverter 146 acts with upper flanges 240 of side rails 142 and 144 to form the upper surface of the rail and closure structure to which skylight frame 132 is mounted.

Lower flange 410 of diverter 146 runs along, and parallel to, panel flat 114 of the respective roof panel. Diverter 146 also has a diversion surface 420 and fastener holes 430 along the lower flange. Diversion surface 420 is typically a flat surface defining first and second obtuse angles with lower flange 410 and intermediate end panel 415. Diversion surface 420 has relatively greater width "W" on the side of the closure structure which is against the rib which is not cut, and a relatively lesser width "W", approaching a nil dimension, adjacent rib gap 122, thus to divert water toward gap 122.

At the closed rib end is a rib mating surface 440 and at the cut rib end is a rib sealing plate 450 extending through gap 122.

Figure 14:
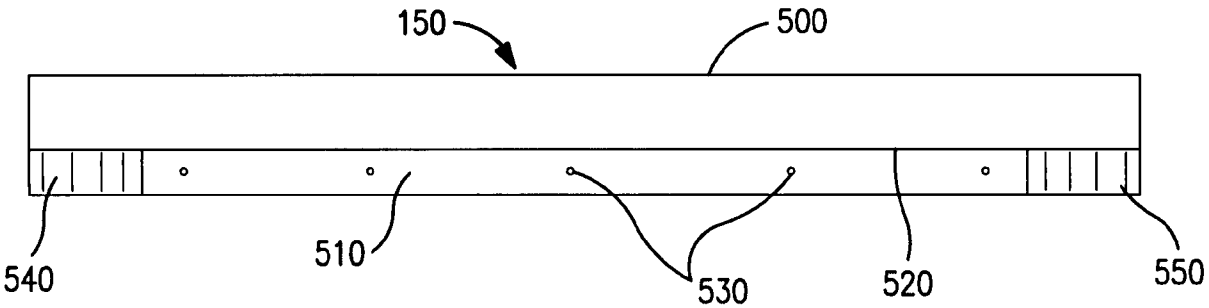
FIG. 14 is a top view of the lower end roof panel profile closure or lower closure of the rail and closure structure.
Figure 15:
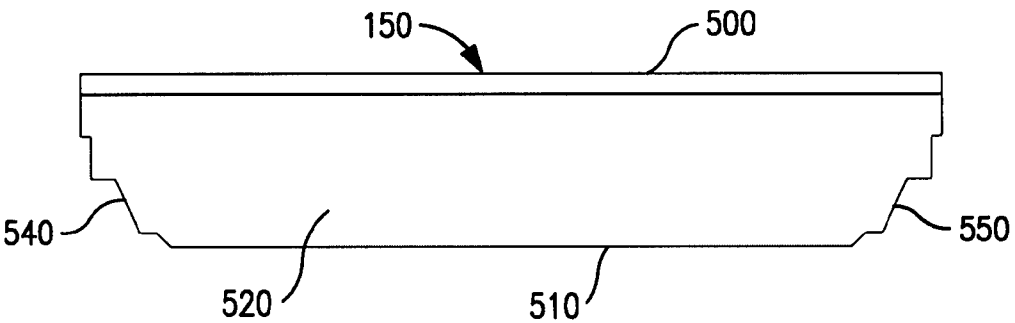
FIG. 15 is a front plan view of the lower end roof panel profile closure or lower closure of the rail and closure structure.
Figure 16:
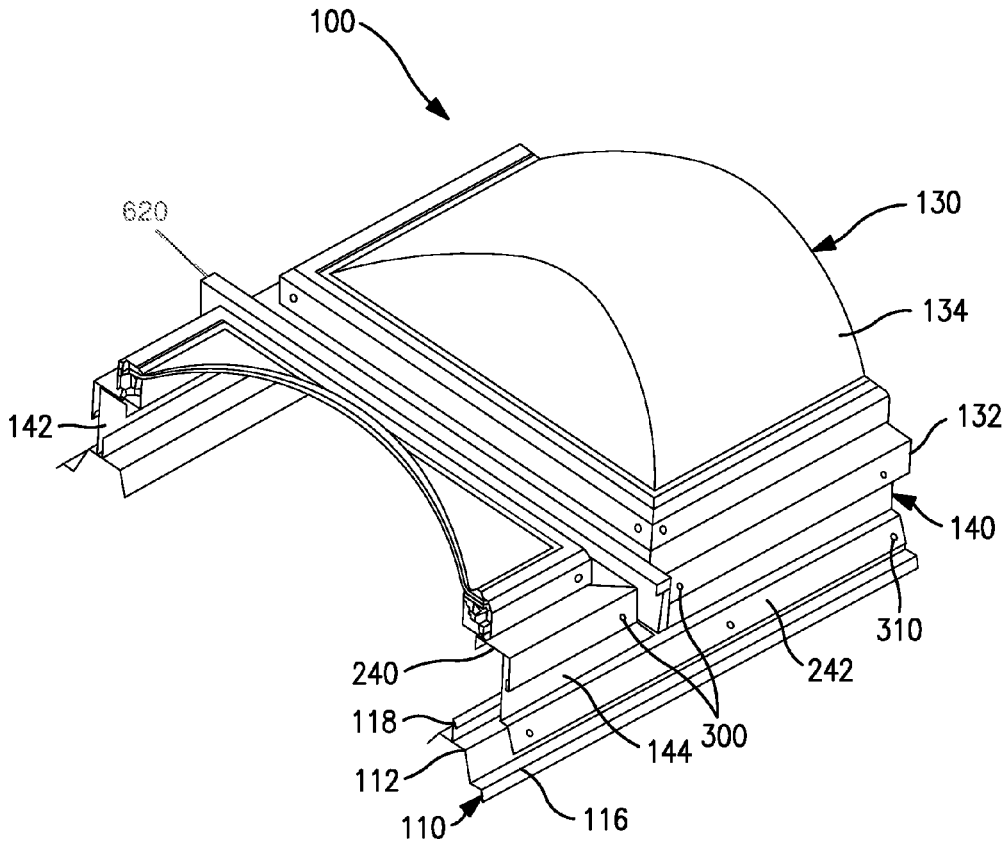
FIG. 16 is a perspective and partially cut away view showing a connection of adjacent skylights of the system.

FIGS. 14 through 16 show the lower closure 150 that is used to maintain a weather tight seal at the lower end of the assembly. Shown again in reference to the side rails 142 and 144 of a standing seam panel roof 110, the closure 150 is adapted to fit the profile of the rib 112. Side rails 142 and 144 abut the closure 150 and the height of closure 150 matches the heights of side rails 142, 144.

Closure 150 has an upper flange 500 and a lower flange 510, as well as a closure web 520. Lower flange 510 includes fastener holes 530.

Closure 150 also includes rib mating flanges 540 and 550 to provide a tight fit along ribs 112.

Figure 17:
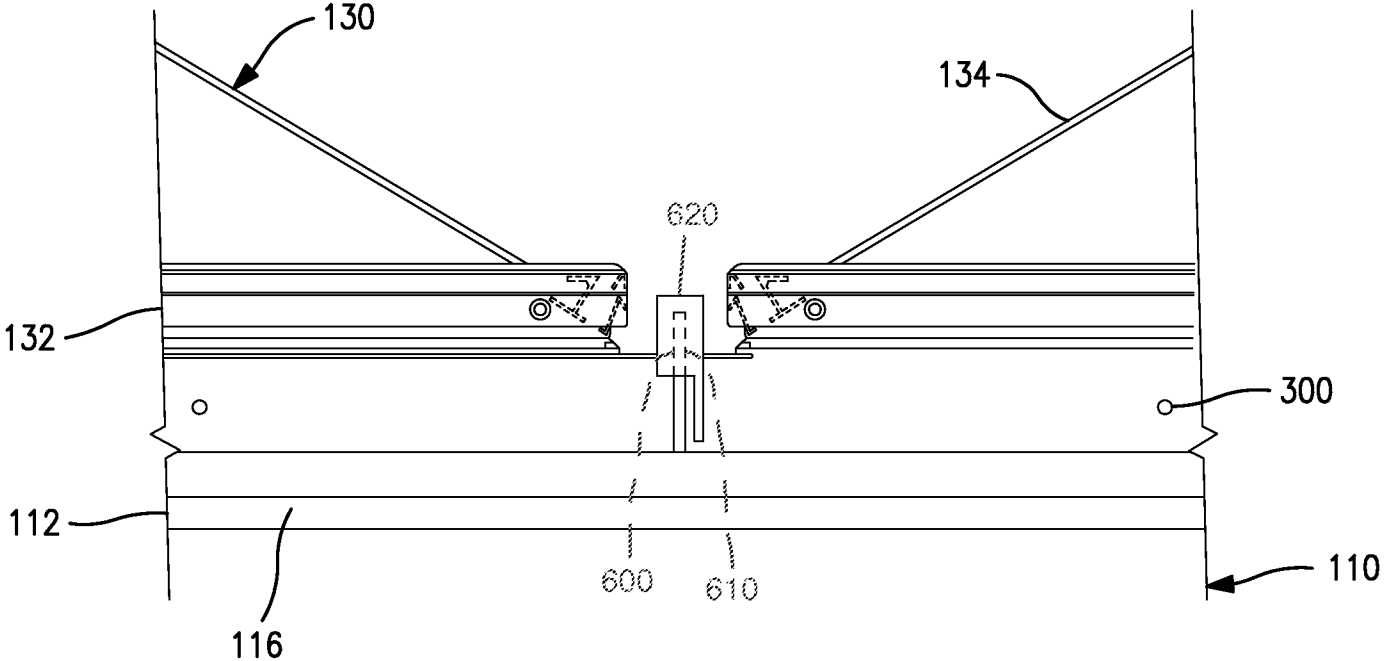
FIG. 17 shows additional detail of how the adjacent skylight ends are joined to each other.

Looking now to FIGS. 17 and 18, the adaptation of the system for the application of multiple roof penetrating structures is described. A chief aspect of the assembly 100 is the reduction in the number of roof penetrations required to provide daylight to the interior of a structure, as fewer, longer cuts can be made along the roof elevations. This reduced number of openings in the roof can be maintained along a single rib, if desired, with one continuous opening, versus a greater number of smaller openings, providing for an equal or greater quantity of ambient light being brought into the building.

In the case of standing seam roofs, the system provides the ability to remove only a portion of the bottom flat portion of the panel. This maintains the structural integrity of the roof in that multiple sections of major panel elevations in adjacent roof panels are not removed, as is done to accommodate a "typical" curb assembly which spans multiple roofing panels. Thus, the roof's structural integrity is not compromised to that extent and there are fewer potential areas for water infiltration, in that the upper reaches of the skylight panels can be mounted in the roof adjacent the ridge of the building and can extend to the eave, requiring water to be diverted only once near the ridge of roof plane and only across one panel flat.

To the limited extent that cutaways are made to the elevations/ribs, such cutaways extend only a minimal length of the respective roof panels, on the order of a few inches or less, solely for the purpose of allowing drainage past the upper end of the strip skylights.

The rail system of the skylight systems of the invention is designed to be installed to either the inside or outside of the major rib elevation for any of the aforementioned roof panel profiles relative to the included flat portion of the roofing panel.

The rail and closure assembly 100 is particularly useful for continuous runs, where individual skylights are arranged end to end. FIGS. 16 and 17 show how two adjacent skylights of the rail and closure assembly 100 can be affixed along a standing seam roof 110. Instead of supplying the individual lights with diverters and lower closures, where adjacent lights abut, the rail and closure structures 140 are provided with upper and lower standing rib frames 600 and 610 at adjacent ends of the adjacent structures 140. A batten 620 is provided to secure closure of the system 100 against the elements at the joinder where frames 600, 610 meet.

As a non-limiting example, skylights can be produced in units of up to 10 feet long, and connected in this fashion for as long as necessary, as each skylight unit is supported by the primary rib of the profile. The standing rib elevation (the major corrugation) extends longitudinally along the length of the assembly and receives the entire lengths of the sides of the entire assembly 100, regardless of the number of adjacent skylight structures 140. No water can enter over the top of the rail and closure assembly.

Where skylight 130 starts at the ridge of the roof, a simple flashing can be inserted under the ridge cap.

Where the ridge cap has a configuration to fit the rib elevations (major corrugation) in the roofing panels, a portion of the rib may be cut out (approximately 2"), allowing the water from the roof panel above to be diverted laterally, sideways on to the next adjacent panel.

If desired, a simple rail enclosure extension can be used to increase the height or distance between an upper portion of the skylight frame and the roof panel, and can be adapted to simply lay over or attach to the top of the rail and closure assembly. Such an extension can be produced to rest along the upper flange of the rail and closure assembly, to effectively raise the height of the skylight or smoke vent to accommodate different skylight depths or other design features, or to accommodate snow conditions and the like. In this fashion, the rail and closure structure can be produced to a standard height, with varying extensions used to elevate the overall height of the structure for such varied purposes. Various forms for such an extension can be suitable, and the skilled artisan will understand various ways and means of designing and manufacturing such extension to accomplish the goal of added elevation for the skylight lens.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A roof adaptive system configured to be installed about an aperture in a sloping metal roof, such metal roof comprising a plurality of roof panels having lengths and widths, said roof panels being arranged side by side, edges of adjacent such roof panels meeting at elevated rib structure portions thereof, thereby to define elevated ribs, and panel flats being disposed between such ribs, said roof adaptive system comprising a rail and closure structure having a length, and being configured to be supported by adjacent ones of the elevated ribs and to extend about such aperture and to span the panel flat portion of a single such roof panel, which panel flat is between adjacent ones of such ribs, said rail and closure structure comprising (a) first and second rails, having lengths, and being configured to be mounted to respective first and second ones of such adjacent ribs on opposing sides of such single panel flat;

(b) an upper diverter configured to extend from said first rail to said second rail across an upper end of such aperture; and (c) a lower closure configured to extend from said first rail to said second rail across a lower end of such aperture.

2. A roof adaptive system as in claim 1, wherein each said rail overlies a such rib, and wherein a lower edge of a respective said rail is above, and displaced from, an elevation of the panel flat of an underlying such roof panel, and wherein an upstanding web of said rail extends upwardly above such rib.

3. A roof adaptive system as in claim 2, further comprising a skylight lens assembly configured to be supported on said rail and closure structure and to overlie such aperture at an elevation above said first and second ribs.

4. A roof adaptive system as in claim 1, further comprising a closure member configured to be supported on said rail and closure structure, and to overlie such aperture above said first and second ribs.

5. A roof adaptive system as in claim 4 wherein a said rail comprises a rail shoulder adapted to be mounted to an upper surface of such rib, and an upstanding web extending upwardly from said rail shoulder and above such rib.

6. A roof adaptive system as in claim 5, said upper diverter having first and second opposing ends, the first such end being configured to extend through a gap in the first rib and onto a next adjacent roof panel at an elevation of a respective panel flat of such next adjacent roof panel, the second end of said upper diverter being configured to conform to at least a portion of the rib structure of such second rib.

7. A roof adaptive system as in claim 5, said closure member being adapted to be mounted to said support structure and wherein said closure member comprises a skylight lens which, when so mounted, is disposed above such first and second ribs.

8. A roof adaptive system as in claim 5 wherein said upstanding web extends upwardly to a bearing surface of said rail, and wherein said closure member is received on said bearing surface.

9. A roof adaptive system as in claim 4 wherein said closure member comprises an operable vent which can be alternatively closed, and opened to the outside environment.

10. A roof adaptive system as in claim 1 wherein said lower closure has a profile which corresponds to at least a portion of a profile of an upper surface of such elevated rib structure.

11. A building, comprising:

(a) a building structural support system;

(b) a sloping roof supported by said building structural support system, said roof comprising a plurality of elongate roof panels arranged side by side and defining a roof panel structure, said roof panels having first lengths and first widths, and opposing first and second sides, said sides of said roof panels comprising elongate elevated rib structure, the elevated rib structure on a given said roof panel being joined with the elevated rib structure on adjacent said roof panels to form first and second elevated ribs at such joinders at the opposing first and second sides of the given said roof panel, said roof panels further comprising panel flats between said ribs, and (c) a roof adaptive system comprising (i) an aperture in said roof, such aperture being confined within the given said roof panel, (ii) a rail and closure structure extending about such aperture, said rail and closure structure having a length and a width and comprising first and second rails mounted to first and second said ribs which border the panel flat of the given said roof panel, said first and second rails being disposed on opposing sides of such aperture, (iii) a gap extending across said first rib at an up-slope end of said rail and closure structure, said rail and closure structure further comprising an upper diverter having first and second ends, said upper diverter extending from said second side rail across the width of the given said roof panel to said first side rail, thereby providing an upper end of said rail and closure structure, including said upper diverter extending through the gap, and thus extending across said first rib, at an elevation corresponding with an elevation of the respective said panel flats at such gap, and extending onto a next adjacent said roof panel, to a first end of said upper diverter, and said rail and closure structure further comprising a lower closure extending from said second side rail, across the given said roof panel to said first side rail, thereby providing a lower end of said rail and closure structure, and (iv) a closure member secured to, and supported by, said side rails, and overlying such aperture, a combination of said rail and closure structure and said closure member thus spanning the panel flat portion of a single said roof panel.

12. A building as in claim 11, the second end of said upper diverter conforming to at least a portion of a profile of the rib structure of said second rib.

13. A building as in claim 11 wherein said rail and closure structure comprises at least first and second said closure members in end-to-end relationship to each other and overlying a single such aperture, said first and second closure members extending along first and second different lengths of such aperture and overlying first and second different portions of an area of such single aperture.

14. A building as in claim 11 wherein a given said rail is fastened only to rib structure of a next adjacent said roof panel, and a lower edge of the given said rail, along an entire length of the respective said rail, is above, and displaced from, the panel flat of such next adjacent roof panel.

15. A building as in claim 11 wherein said rails comprise upstanding webs extending upwardly from said first and second ribs.

16. A building as in claim 11 wherein said lower closure has a profile which corresponds to at least a portion of a profile of a said rib.

17. A building as in claim 11, said closure member comprising a skylight lens assembly.

18. A building as in claim 11 wherein said first rail comprises a rail shoulder mounted to said first rib, and an upstanding web extending upwardly above said rail shoulder and above said first rib to a bearing surface of said first rail, said closure member being received on said bearing surface.

19. A building as in claim 11 wherein said rail and closure structure is secured only to said roof panel structure, and thus is carried by and moves, in expansion and contraction related to temperature changes, with underlying said roof panel structure.

20. A building as in claim 11 wherein said closure member comprises a skylight lens disposed above said first and second ribs.

21. A building as in claim 11 wherein said rails comprise upstanding webs extending upwardly above said ribs.

22. A building as in claim 11 wherein said lower closure extends to an elevation above said first and second ribs.

23. A building as in claim 11 wherein said upper diverter extends to an elevation above said first and second ribs.

24. A building as in claim 11 wherein a lower edge of a given said rail, along an entire length of the respective said rail, is at an elevation above, and displaced from, the panel flat of the next adjacent said roof panel.

25. A building as in claim 24, said closure member comprising a skylight lens assembly disposed at an elevation above said first and second ribs.

26. A building, comprising:

(a) a building structural support system;

(b) a sloping roof supported by said building structural support system, said roof comprising a plurality of elongate roof panels arranged side by side and defining a respective roof panel structure, said roof panels having first lengths, first widths, and opposing first and second sides, said sides of said roof panels comprising elongate elevated rib structure, the elevated rib structure on a given said roof panel being joined with the elevated rib structure on adjacent said roof panels to form first and second elevated ribs at such joinders at the opposing first and second sides of said roof panels, and a panel flat between said first and second ribs, and (c) a roof adaptive system comprising an elongate aperture confined within said given roof panel, such aperture having an aperture length extending along the length of the given said roof panel, (ii) a rail and closure structure extending about such aperture, and comprising A. first and second side rails having first and second rail lengths, the entire lengths of said first and second side rails overlying and being mounted to said first and second ribs, B. an upper diverter extending from said second side rail across the width of the given said roof panel to said first side rail, thereby providing an upper end of said rail and closure structure, C. a lower closure extending from said second side rail across the given said roof panel to said first side rail, thereby providing a lower end of said rail and closure structure, and (iii) a closure member secured to said rail and closure structure and disposed above said panel flat, and extending from said first side rail to said second side rail, and from said upper diverter along the length of said aperture.

27. A building as in claim 26, comprising a plurality of said closure members secured to said rail and closure structure, and extending over such aperture in said given roof panel, said closure members extending from said first side rail to said second side rail, a first said closure member extending from said upper diverter to an intermediate location along the length of the aperture, and a second said closure member extending from such intermediate location away from said upper diverter and toward said lower closure.

28. A building as in claim 26, beam strength of said rib structure providing primary support to said rail and closure structure, supporting said rail and closure structure above said panel flat.

29. A building as in claim 28, said closure member extending upwardly above said first and second ribs.

30. A building as in claim 28, said closure member overlying said rail and closure structure.

31. A building as in claim 26 wherein said rail and closure structure is secured to said roof panel structure, and thus is supported only by, underlying said roof panel structure.

32. A building as in claim 26 wherein a said rail comprises a rail shoulder mounted to a said rib, and further comprises an upstanding web extending upwardly from said rail shoulder, including extending above said rib.

33. A building as in claim 26 wherein a lower edge of a given said rail is at an elevation above, and displaced from, the panel flat of a next adjacent said roof panel.

34. A building as in claim 33, said closure member comprising a skylight lens assembly disposed at an elevation above said first and second ribs.

35. A building, comprising:

(a) a building structural support system;

(b) a sloping roof supported by said building structural support system, said roof comprising a plurality of elongate roof panels arranged side by side, said roof panels having first lengths, first widths, and opposing first and second sides, said sides of said roof panels comprising elongate elevated rib structure, the elevated rib structure on a given said roof panel being joined with the elevated rib structure on adjacent said roof panels to form first and second elevated ribs at such joinders at the opposing first and second sides of the given said roof panel, said roof panel further comprising a panel flat between said first and second ribs, and (c) a roof adaptive system comprising (i) an elongate aperture confined within said given roof panel, such aperture having an aperture length extending along the length of the given said roof panel and a width extending across the width of the given said roof panel, (ii) a rail and closure structure extending about such aperture, and comprising A. first and second side rails overlying and being mounted to said first and second ribs, B. an upper diverter extending from said second side rail across the width of the given said roof panel to said first side rail, thereby providing an upper end of said rail and closure structure, C. a lower closure extending from said second side rail across the given said roof panel to said first side rail, thereby providing a lower end of said rail and closure structure, and (iii) a plurality of closure members secured to said rail and closure structure and overlying a single such aperture, and extending from said first side rail to said second side rail, a first said closure member overlying a first portion of an area of such confined aperture and extending from said upper diverter to an intermediate location along the length of such confined aperture between said upper diverter and said lower closure, a second said closure member overlying a second different portion of the area of such aperture and extending from such intermediate location away from said upper diverter and toward said lower closure.

36. A building as in claim 35, full lengths of said first and second side rails overlying and being mounted to said first and second ribs.

37. A building as in claim 36, beam strength of said rib structure providing primary support to said rail and closure structure, supporting said rail and closure structure at an elevation above said panel flat.

38. A building as in claim 37, said closure members being disposed at an elevation above said panel flat.

39. A building as in claim 38, said closure members overlying said rail and closure structure.

40. A building as in claim 38, said closure members extending, from said rail and closure structure, upwardly above said first and second ribs.

41. A building as in claim 35 wherein said rail and closure structure is secured only to said roof structure, and thus is supported only by, underlying said roof structure.

42. A building as in claim 35 wherein a said rail comprises a rail shoulder mounted to a said rib, and an upstanding web extending upwardly from said rail shoulder and above said rib.

43. A building as in claim 35 wherein a lower edge of a given said rail is at an elevation above, and displaced from, the panel flat of a next adjacent said roof panel.

44. A building as in claim 43, said closure member comprising a skylight lens assembly disposed at an elevation above said first and second ribs.

45. A roof adaptive system installed about an aperture in a sloping metal roof, such metal roof comprising a plurality of elongate roof panels, said roof panels being arranged side by side, edges of adjacent such roof panels meeting at elevated rib structure portions thereof, thereby defining elevated ribs, said elevated ribs including folded over standing seams, panel flats being disposed between such ribs, said roof adaptive system comprising a plurality of closure members supported by first and second adjacent ones of the elevated ribs, and extending about such aperture and across such single panel flat portion of a single such roof panel, which panel flat is between the first and second adjacent ones of such ribs.

* * * * *